US010550514B2

(12) United States Patent
Matsumoto

(10) Patent No.: US 10,550,514 B2
(45) Date of Patent: Feb. 4, 2020

(54) CLOTH HEATING APPARATUS, CLOTH HEATING METHOD, METHOD OF APPLYING IMAGE TO CLOTH, MEDIUM HEATING APPARATUS

(71) Applicant: Ricoh Company, Ltd., Tokyo (JP)

(72) Inventor: Hiroyoshi Matsumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 209 days.

(21) Appl. No.: 15/730,925

(22) Filed: Oct. 12, 2017

(65) Prior Publication Data

US 2018/0105979 A1 Apr. 19, 2018

(30) Foreign Application Priority Data

Oct. 17, 2016 (JP) ..... 2016-203946
Jun. 30, 2017 (JP) ..... 2017-129751

(51) Int. Cl.

| | |
|---|---|
| ***D06P 5/20*** | (2006.01) |
| ***F26B 23/04*** | (2006.01) |
| ***D06P 5/00*** | (2006.01) |
| ***F26B 9/00*** | (2006.01) |
| *B41M 7/00* | (2006.01) |
| *D06P 5/24* | (2006.01) |

(52) U.S. Cl.

CPC ..... *D06P 5/2066* (2013.01); *D06P 5/001* (2013.01); *D06P 5/2072* (2013.01); *D06P 5/2077* (2013.01); *F26B 9/003* (2013.01); *F26B 23/04* (2013.01); *B41M 7/009* (2013.01); *D06P 5/003* (2013.01)

(58) Field of Classification Search

CPC ..... D06P 5/2066; D06P 5/001; D06P 5/2072; D06P 5/2077; D06P 5/003; D06P 5/20; B41J 11/00; B41J 3/407; B41J 13/10; F26B 9/003; F26B 23/04; B32B 33/00; B41M 7/00; B41M 7/009; D06C 3/08

See application file for complete search history.

(56) References Cited

U.S. PATENT DOCUMENTS 4,277,901 A * 7/1981 Williams ..... B44D 3/185 118/503
5,249,255 A * 9/1993 Fuqua ..... B41F 15/12 101/115

(Continued)

FOREIGN PATENT DOCUMENTS

CN 200988331 Y 12/2007
CN 104943369 A 9/2015

(Continued)

OTHER PUBLICATIONS

Combined Chinese Office Action and Search Report dated Jan. 31, 2019 in Chinese Patent Application No. 201710958268.X (with English translation of Category of Cited Documents), 10 pages.

*Primary Examiner* — Ismael Izaguirre
(74) *Attorney, Agent, or Firm* — Xsensus LLP

(57) ABSTRACT

A cloth heating apparatus includes a body, a receiver, a cloth holder, and a heater. The receiver is disposed in the body. The cloth holder is removably attached to the receiver, to hold a cloth. The heater is disposed in the body, to heat the cloth. The cloth holder is removably attachable to a printing apparatus to print an image on the cloth, with the cloth held on the cloth holder.

10 Claims, 12 Drawing Sheets

(56) References Cited

U.S. PATENT DOCUMENTS

| | | | | |
|---|---|---|---|---|
| 5,575,877 | A * | 11/1996 | Hale | B41J 2/315 156/230 |
| 6,155,170 | A * | 12/2000 | Benedetto | B41F 15/12 101/424.1 |
| 6,832,569 | B2 * | 12/2004 | Krasnitz | B41F 15/22 101/127.1 |
| 6,908,190 | B2 * | 6/2005 | Iwatsuki | B41J 3/4078 101/474 |
| 8,833,886 | B2 * | 9/2014 | Kanaya | B41J 3/4078 347/104 |
| 9,073,369 | B2 * | 7/2015 | Yanagishita | B41J 15/16 |
| 2005/0111862 | A1 * | 5/2005 | Fuma | G03G 15/2064 399/67 |
| 2007/0103529 | A1 | 5/2007 | Pearl et al. | |
| 2007/0199491 | A1 * | 8/2007 | Riezu Bravo | B44C 1/1712 112/103 |
| 2011/0242189 | A1 | 10/2011 | Okada et al. | |
| 2013/0278698 | A1 * | 10/2013 | Takeuchi | B41J 13/10 347/104 |
| 2015/0273866 | A1 * | 10/2015 | Sakai | B41J 11/002 347/21 |
| 2016/0009057 | A1 | 1/2016 | Dolsey | |
| 2016/0229199 | A1 | 8/2016 | Nakai et al. | |

FOREIGN PATENT DOCUMENTS

| | | | |
|---|---|---|---|
| CN | 106574436 | A | 4/2017 |
| JP | 2002-096453 | | 4/2002 |
| JP | 2009-209493 | A | 9/2009 |
| JP | 2014-162171 | | 9/2014 |

* cited by examiner

FIG. 3A

| HEAVY-WEIGHT SHIRT | TEMPER-ATURE (°C) | TIME (min) | | | | |
|---|---|---|---|---|---|---|
| | | 0 | 0.5 | 1.0 | 2.0 | 3.0 |
| | 160 | 1.00 | 0.99 | 1.00 | 0.97 | 0.97 |
| | 170 | 1.00 | 1.00 | 1.05 | 1.01 | 1.05 |

FIG. 3B

| SWEAT SHIRT | TEMPER-ATURE (°C) | TIME (min) | | | | |
|---|---|---|---|---|---|---|
| | | 0 | 0.5 | 1.0 | 2.0 | 3.0 |
| | 160 | 1.00 | 1.01 | 0.99 | 1.02 | 1.07 |
| | 170 | 1.00 | 1.01 | 1.04 | 1.09 | 1.16 |

FIG. 3C

| LIGHT-WEIGHT SHIRT | TEMPER-ATURE (°C) | TIME (min) | | | | |
|---|---|---|---|---|---|---|
| | | 0 | 0.5 | 1.0 | 2.0 | 3.0 |
| | 160 | 1.00 | 1.00 | 1.01 | 1.01 | 1.04 |
| | 170 | 1.00 | 1.01 | 1.02 | 1.06 | 1.13 |

CLOTH HEATING APPARATUS, CLOTH HEATING METHOD, METHOD OF APPLYING IMAGE TO CLOTH, MEDIUM HEATING APPARATUS

CROSS-REFERENCE TO RELATED APPLICATIONS

This patent application is based on and claims priority pursuant to 35 U.S.C. § 119(a) to Japanese Patent Application Nos. 2016-203946, filed on Oct. 17, 2016, and 2017-129751, filed on Jun. 30, 2017 in the Japan Patent Office, the entire disclosure of each of which is hereby incorporated by reference herein.

BACKGROUND

Technical Field

Aspects of the present disclosure relate to a cloth heating apparatus, a cloth heating method, a method of applying an image to a cloth, and a medium heating apparatus.

Related Art

An apparatus is known that includes a support to support a cloth, a head to discharge a liquid onto a medium conveyed on the support, and a drying unit to dry the liquid landed on the medium. The apparatus includes a heating area and a non-heating area. The drying unit is disposed in the heating area, and the support and the head are disposed in the non-heating area.

In an apparatus, such as a textile printing apparatus, to apply an image on a cloth (including a processed article, such as a T-shirt), for example, when printing is performed using a liquid discharge head, the apparatus not only dries the cloth on which liquid is adhered to print an image, but also fixes the image on the cloth by heating the cloth for a certain period of time at relatively high temperature.

SUMMARY

In an aspect of the present disclosure, there is provided a cloth heating apparatus that includes a body, a receiver, a cloth holder, and a heater. The receiver is disposed in the body. The cloth holder is removably attached to the receiver, to hold a cloth. The heater is disposed in the body to heat the cloth. The cloth holder is removably attachable to a printing apparatus to print an image on the cloth, with the cloth held on the cloth holder.

In another aspect of the present disclosure, there is provided a cloth heating method using the cloth heating apparatus. The method includes one of pressing the heater and the cloth held on the cloth holder with a pressure of 50 kPa or less and holding the heater and the cloth held on the cloth holder in non-contact with each other; and heating the cloth holder with the heater at a temperature of 170° C. or less for a time period of one minute or greater and two minutes or less.

In still another aspect of the present disclosure, there is provided a cloth heating method using the cloth heating apparatus. The method includes heating the cloth before the image is printed on the cloth, and heating the cloth after the image is printed on the cloth with the printing apparatus.

In still yet another aspect of the present disclosure, there is provided a method of applying an image to a cloth. The method includes holding a cloth on a cloth holder; attaching the cloth holder holding the cloth to a cloth heating apparatus; preheating the cloth with the cloth holder holding the cloth being attached to the cloth heating apparatus; removing the cloth holder from the cloth heating apparatus after the preheating; attaching the cloth holder removed from the cloth heating apparatus to a printing apparatus; printing an image on the cloth with the printing apparatus; removing the cloth holder from the printing apparatus after the printing; attaching the cloth holder removed from the printing apparatus to the cloth heating apparatus; and postheating the cloth having the image, with the cloth holder holding the cloth being attached to the cloth heating apparatus.

In still further yet another aspect of the present disclosure, there is provided a medium heating apparatus that includes a body, a receiver, a medium holder, and a heater. The receiver is disposed in the body. The medium holder is removably attached to the receiver, to hold a medium. The heater is disposed in the body, to heat the medium. The medium holder is removably attachable to a printing apparatus to print an image on the medium, with the medium held on the medium holder.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIGS. 3A to 3C are tables of examples of relationship between heating and damage to cloth;

Figure 1:
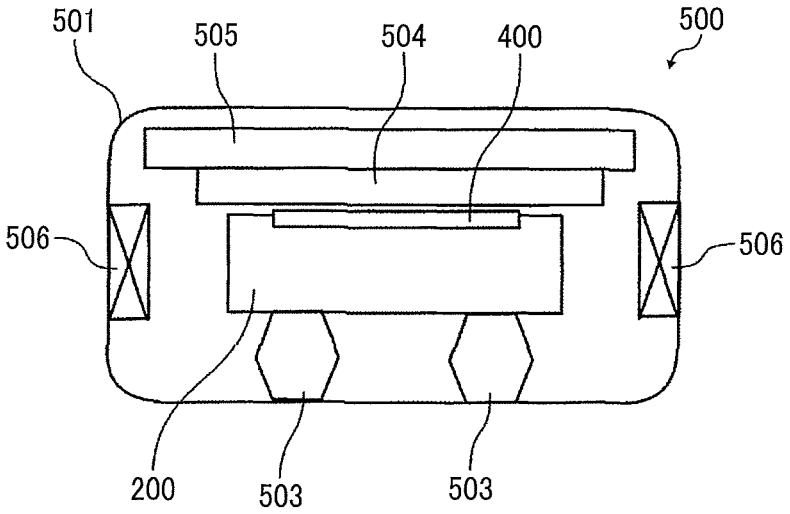
FIG. 1 is a schematic view of an apparatus (heating apparatus) of heating a cloth according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, wherein like reference numerals designate identical or corresponding parts throughout the several views, embodiments of the present disclosure are described below. A heating apparatus to heat a cloth (hereinafter referred to as "heating apparatus") according to a first embodiment of the present disclosure is described with reference to FIG. 1. FIG. 1 is a schematic view of the heating apparatus in the present embodiment.

The heating apparatus 500 includes a receiver 503 and a heater 504 in a body 501. A cassette 200 is a tray (hereinafter referred to as "cloth holder") to hold a cloth 400 to which an image is to be applied, and is detachably mounted (or may be only "placed") on the receiver 503. The heater 504 is a heating unit that heat the cloth 400 in contact or non-contact with the cloth 400. The cassette 200 as the cloth holder can also be used for an apparatus (printing apparatus) that prints an image on the cloth 400 while holding the cloth 400.

The heater 504 is preferably, for example, a mica heater or a silicon rubber heater. Since the silicon rubber heater heats the cloth 400 with rubber having a flexible surface, a flat plate, such as a sheet metal, is preferably disposed on the surface to heat the cloth 400. Fluorine resin processing or water repellent processing is preferably performed on the cloth-side surface of the flat plate to prevent adhesion of ink.

The receiver 503 also acts as a moving device to relatively move the cassette 200 back and forth (in this case, upward and downward) with respect to the heater 504 as the heating unit, to relatively move the cloth 400 held by the cassette 200 and the heater 504.

In the body 501, a heat insulator 505 is disposed above the heater 504. Fans 506 are disposed on lateral sides of the body 501.

Next, a series of flows of a method of heating a cloth using the heating apparatus 500 and a method of applying an image to the cloth are described below.

First, a cloth 400, to which an image is to be applied, is held on the cassette 200.

Next, the cassette 200 holding the cloth 400 is mounted and set on the receiver 503 of the heating apparatus 500. The receiver 503 is raised, and the cloth 400 is pressed against the heater 504 with a predetermined pressing force.

At this time, the heater 504 generates heat at a predetermined temperature to heat the cloth 400 pressed against the heater 504. After heating for a predetermined time, the receiver 503 descends and the cloth 400 is separated from the heater 504 (preliminary process). Thus, the cassette 200 is taken out from the heating apparatus 500 while holding the cloth 400. Note that water is preferably applied to the cloth in a mist form before heating.

Then (after completion of the preliminary process), the cassette 200 is set in a printing apparatus 1, which is described later, to perform desired printing (printing process).

After completion of the printing process, the cassette 200 holding the cloth 400, on which the image has been printed, is taken out of the printing apparatus 1 and set on the receiver 503 of the heating apparatus 500. Then, the receiver 503 is raised, and the printed cloth 400 is brought closer to the heater 504 and heated. After heating for a predetermined time, the receiver 503 descends (post process and fixing process).

In the post process, the cloth 400 and the heater 504 are not pressed against each other. The heater 504 heats the cloth 400 without contacting the cloth 400. Such a configuration can reduce contamination on the printed surface and damage to the cloth 400. Alternatively, the heater 504 may heat the cloth 400 while contacting the cloth 400 in the post process with a weaker pressing force than in the preliminary process.

Note that the ascending and descending of the cassette 200 may be performed by automatically or manually moving the receiver 503.

In this manner, the cassette 200 holding the cloth 400, on which the image is printed with the printing apparatus 1, can be used in the heating apparatus 500 without being removed from the heating apparatus 500. As a result, the cloth can be heated simply by setting the cassette 200 as the cloth holder holding the cloth in the heating apparatus 500, thus enhancing the workability in heating the cloth. Such a configuration can prevent the printed surface of the cloth 400 from being disturbed by wrinkles or partial overlap even when the cloth 400 is carried, thus enhancing the workability in applying (printing and heating) an image on the cloth 400.

In the above-described example, the heating apparatus 500 is used before and after the printing process. In some embodiments, for example, the heating apparatus 500 may be used only in the preliminary process or the post process of the printing process.

Here, an example of the fixing performance when a silicon rubber heater is used as the heating unit is described below.

The fixing performance was evaluated by wet fastness according to Japanese Industrial Standard (JIS) L-0849.

Printing was performed on a cloth of 100% cotton with a printing apparatus and ink containing water, ethylene glycol, acetone, etc. was fixed on the cloth at predetermined fixing conditions (pressing force: pressure, temperature, and time: heating time (contact time)). A heavy-weight T-shirt was used as the cloth.

As the fixing conditions, the following four conditions were used and compared. Note that the pressure of 0 kPa indicates a state in which the cloth and the heating portion are not in contact with each other.

Condition 1: pressure 50 kPa, temperature 165° C., and time 2 minutes

Condition 2: pressure 82 kPa, temperature 195° C., and time 2 minutes

Condition 3: pressure 0 kPa, temperature 150° C., and time 30 seconds

Condition 4: pressure 0 kPa, temperature 165° C., time 1 minute

The measurements were performed according to JIS L-0849. Ink rubbed and adhered to a test piece was measured with a reflection densitometer. Results of the measurements are presented in FIG. 2.

Figure 2:
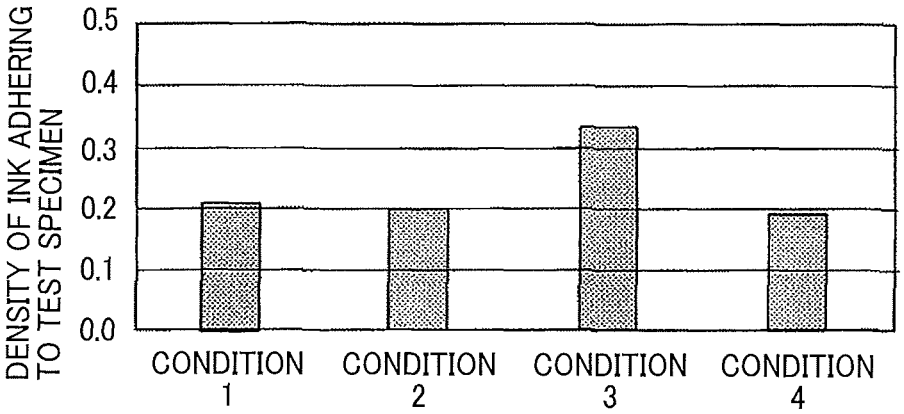
FIG. 2 is a graph of an example of fixing performance when a silicone rubber heater is used as a heating unit.

From the results of FIG. 2, it can be seen that the fastness in the case of Condition 3 of non-contact, relatively low temperature, and short heating time is lower than the fastness in the case of any of the other Conditions 1, 2, and 4. FIG. 2 presents the results of the heavyweight T-shirt. However, similar results are obtained for trainers and lightweight T-shirts.

Next, heating and damage to the cloth were evaluated.

Here, as illustrated in FIGS. 3A to 3C, a heavyweight T-shirt (of a thickness of about 0.9 mm), a trainer, a lightweight T-shirt (of a thickness of about 0.2 mm) are used as the cloths. The heating temperature was set to 160° C. and 170° C. The heating time was set to 0.5 minutes, 1 minute, 2 minutes, and 3 minutes. The cloths were heated with no load (non-contact).

Then, the density of black (Bk) of each heated cloth was measured with a reflection spectral densitometer (of the model name 939 manufactured by X-Rite Inc.). FIGS. 3A to 3C presents conversion values obtained when the reflection density prior to heating (at the heating time of 0) is set to "1.00". For example, in the column of heavyweight T-shirt in FIG. 3A, the value "1.05", which was obtained by heating the cloth at the temperature of 170° C. for 3 minutes, indicates that the density was 1.05 times of the density prior to heating (at the heating time of 0).

As a result, the trainer heated at 170° C. for 3 minutes had a density of about 1.16 times higher than before heating, such that the difference in density between before and after the heating can be seen visually. Likewise, the trainer heated for 2 minutes had a slight change in density. The lightweight T-shirt heated at 170° C. for 3 minutes also had a slight change in density. The heavy-weight T-shirt did not have so much visible change in density as the other cloths.

From the results, it can be found that, depending on the type of the cloth, even in no load (non-contact) state, the cloth may be damaged when the cloth is exposed to the heater at high temperature for a long time.

Here, it is considered preferable to treat the cloth at high pressure and high temperature to fix an image on the cloth in a short time. However, to reduce damage to the cloth, it is preferable to set the pressure to about 50 kPa or less, the temperature to 170° C. or less, the time to 1 minute or greater and 2 minutes or less. Such a configuration can maintain high print quality while reducing damage to a wide range of cloths from thin cloth to thick cloth.

Figure 4:
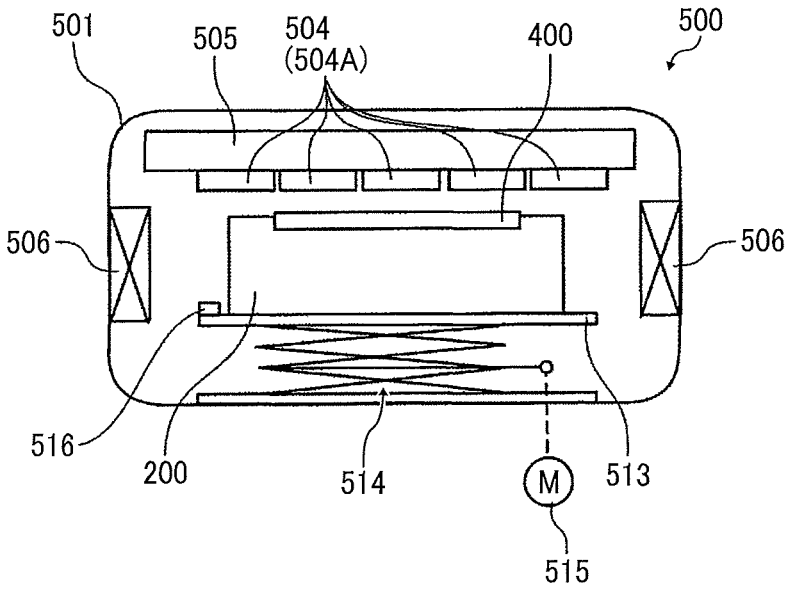
FIG. 4 is a schematic view of the apparatus (heating apparatus) of heating a cloth according to a second embodiment of the present disclosure.
Figure 5:
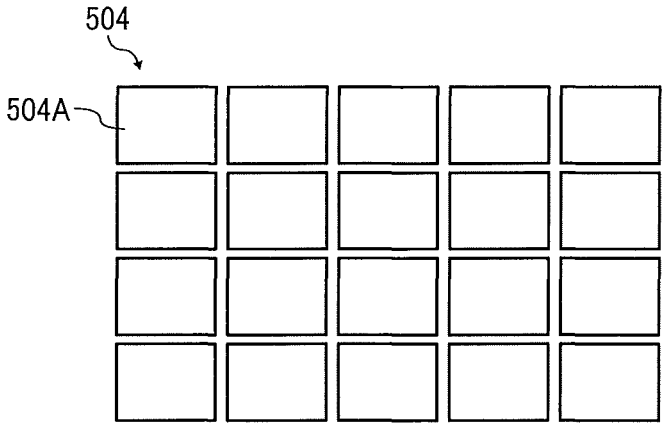
FIG. 5 is a plan view of an example of the heating unit.

Next, a second embodiment of the present disclosure is described with reference to FIGS. 4 and 5. FIG. 4 is a schematic view of the apparatus (heating apparatus) of heating cloth according to the second embodiment. FIG. 5 is a plan view of the heater in the second embodiment.

In the present embodiment, the heating apparatus 500 includes a table 513 to receive the cassette 200 and a lift 514 constituted of a pantograph jack as a moving device to move the table 513 upward and downward. The lift 514 constituted of the pantograph jack can control driving of a motor 515 disposed outside the body 501 to adjust the height of the lift 514, thus allowing adjustment of the distance between the table 513 as a receiving member and the heater 504.

The table 513 is provided with a distance sensor 516 to measure the distance to the heater 504 so that the height position of the table 513 can be adjusted according to the thickness of the cloth 400.

The heater 504 as the heating unit includes a plurality of heater portions 504A that are a plurality of heating regions (divided heating regions) in which the amount of heat generation can be changed. Each of the heater portions 504A can control ON/OFF and heat generation amount.

Figure 6:
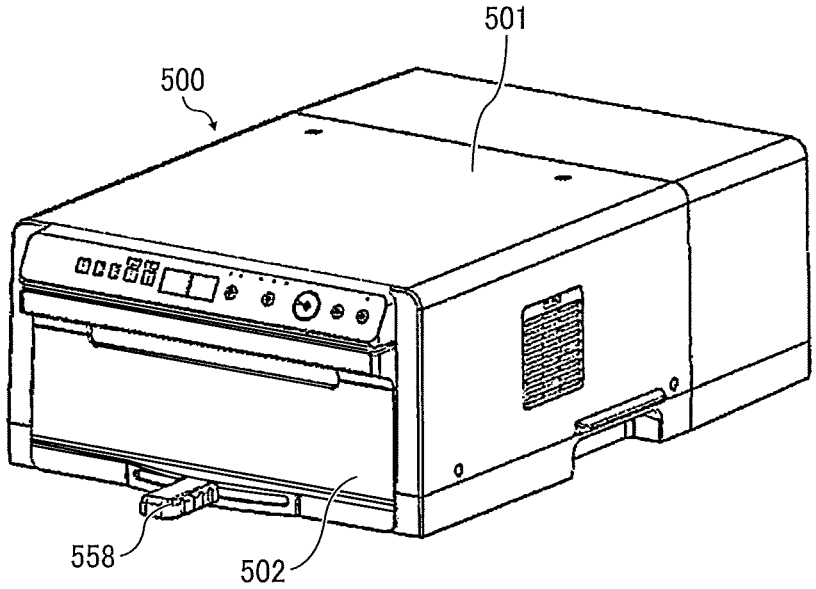
FIG. 6 is an outer perspective view of the apparatus (heating apparatus) of heating a cloth according to a third embodiment of the present disclosure.
Figure 7:
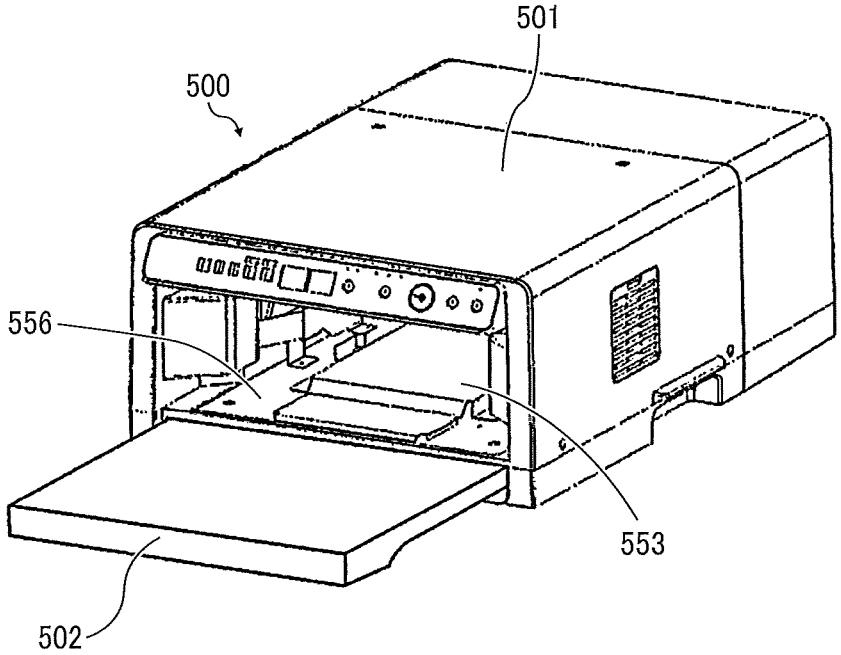
FIG. 7 is a perspective view of a state in which a front cover (front door) of the heating apparatus of FIG. 6 is opened.
Figure 8:
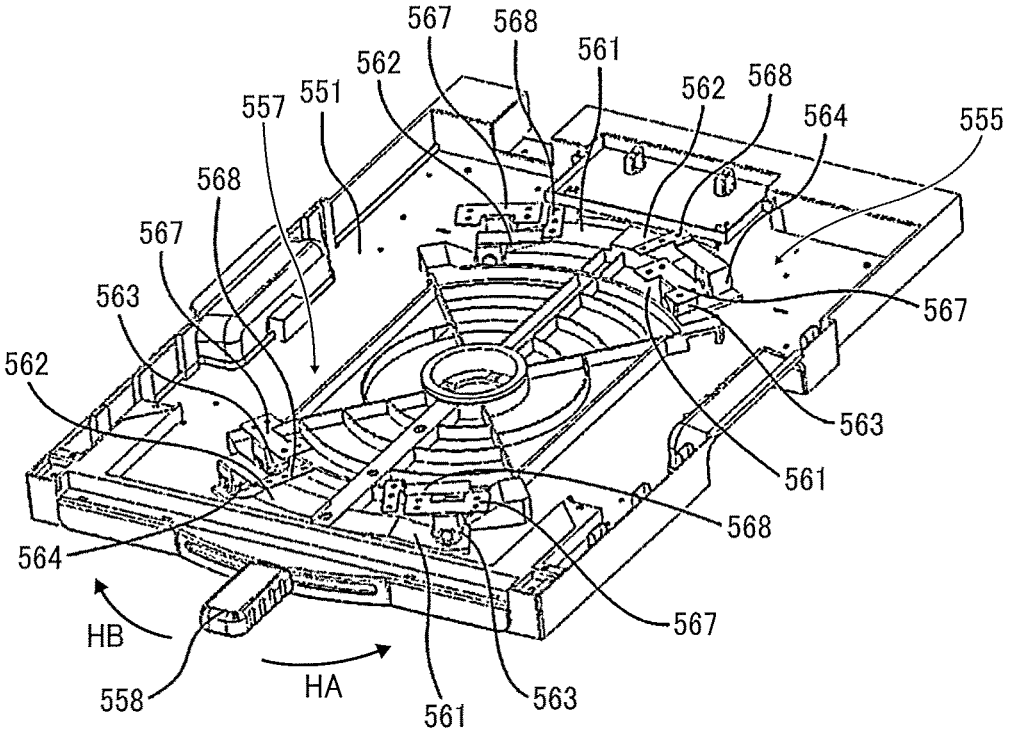
FIG. 8 is a perspective view of an elevation assembly of the heating apparatus of FIG. 6.
Figure 9:
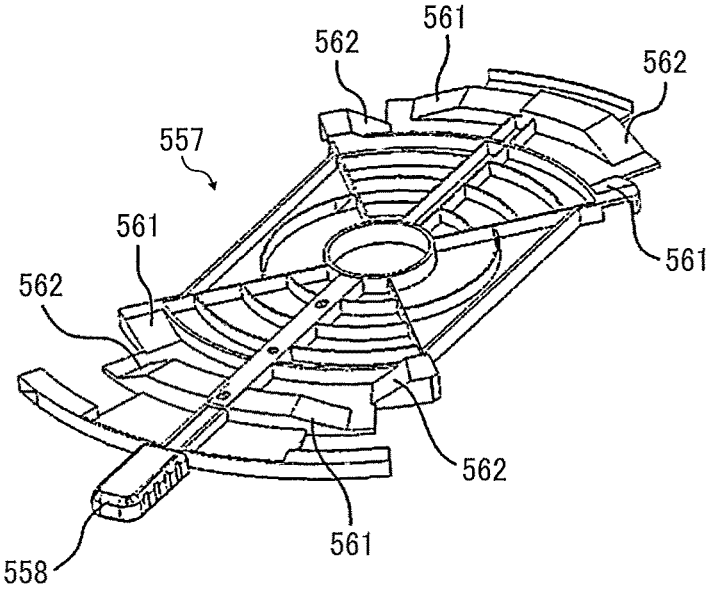
FIG. 9 is a perspective view of a cam assembly of the elevation assembly of FIG. 8.

Next, the apparatus (heating apparatus) of heating cloth according to a third embodiment of the present disclosure is described with reference to FIGS. 6 to 9. FIG. 6 is an external perspective view of the heating apparatus according to the third embodiment. FIG. 7 is a perspective view of a state in which a front cover (front door) of the heating apparatus of FIG. 6 is opened. FIG. 8 is a perspective view of an elevation assembly of the heating apparatus of FIG. 6. FIG. 9 is a perspective view of a cam assembly in the elevation assembly of FIG. 8.

The heating apparatus 500 includes a front cover 502, which is operable and closable, on a front face of the body 501. The heating apparatus 500 includes a table 553 and a heating unit in the body 501. The table 553 is a receiving member on which the cassette 200 to hold cloth 400 is detachably mounted (placed). The heating unit heats the cloth. Similarly with the above-described embodiments, the cassette 200, which is the cloth holder, can also be used for an apparatus (printing apparatus) that prints an image on the cloth 400 while holding the cloth 400.

The table 553 is held on a table elevation assembly 555.

The table elevation assembly 555 includes a holding table 556 (see FIG. 7) to hold the table 553 and a cam assembly 557 to move the holding table 556 upward and downward.

The cam assembly 557 includes an elevation lever 558 held in a bottom plate 551 of the body 501 so as to be rotatable in a horizontal direction. The elevation lever 558 is provided with a first inclined cam portion 561 and a second inclined cam portion 562 that have different heights from each other. Note that the height of the uppermost surface of the first inclined cam portion 561 is lower than the height of the uppermost surface of the second inclined cam portion 562.

Roller holders 567 and 568 are secured on the bottom surface of the holding table 556. The roller holders 567 and 568 rotatably holds a first roller 563 that follows the first inclined cam portion 561 and a second roller 564 that follows the second inclined cam portion 562. The holding table 556 is held on the cam assembly 557 via the first roller 563 and the second roller 564.

Here, as illustrated in FIG. 8, when the elevation lever 558 is rotated in a direction indicated by arrow HA from an initial position at which the elevation lever 558 is centered, the first roller 563 moves over the first inclined cam portion 561. Accordingly, the holding table 556 is raised to a height H1.

Similarly, when the elevation lever 558 is rotated in a direction indicated by arrow HB in FIG. 8 from the initial position, the second roller 564 moves over the second inclined cam portion 562. Accordingly, the holding table 556 is raised to a height H2 (H2>H1).

As described above, since the holding table 556 is moved up and down by operating the elevation lever 558, the height of the cassette 200, which is placed on the table 553 held by the holding table 556, changes, thus allowing adjustment of a gap and a pressing force between the cloth and the heating unit.

Figure 10:
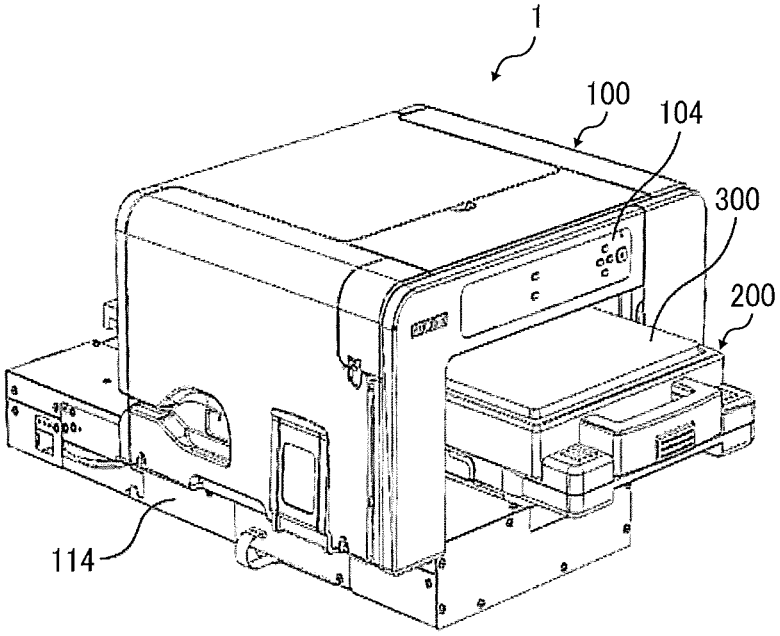
FIG. 10 is an outer perspective view of an example of a printing apparatus.
Figure 11:
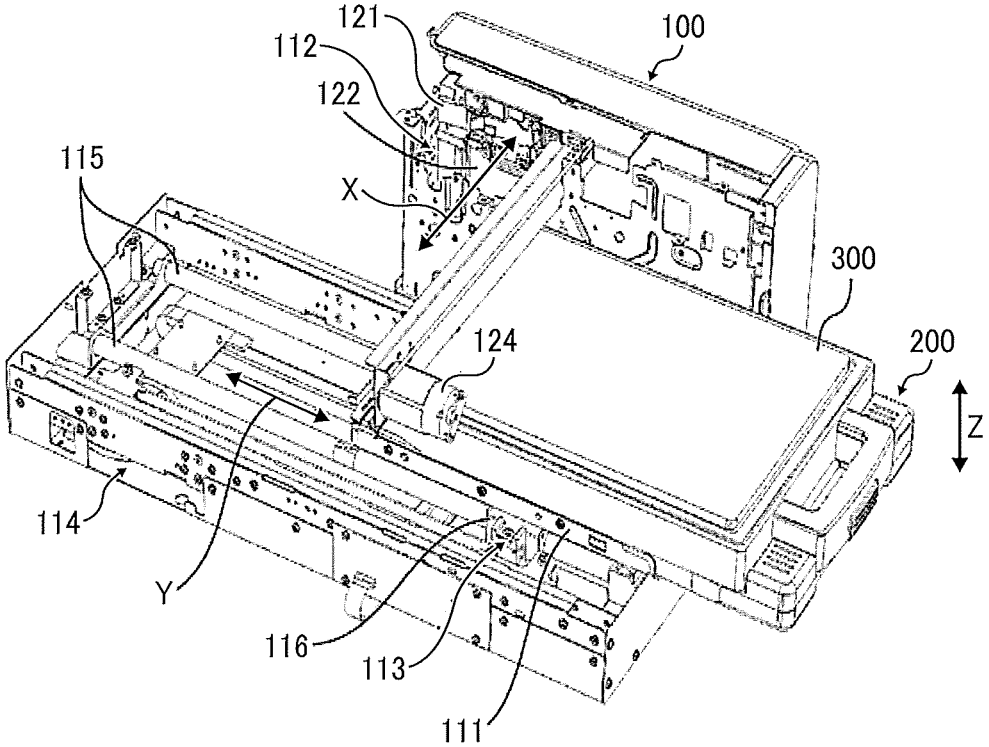
FIG. 11 is a perspective view of an entire configuration of the printing apparatus of FIG. 10.
Figure 12:
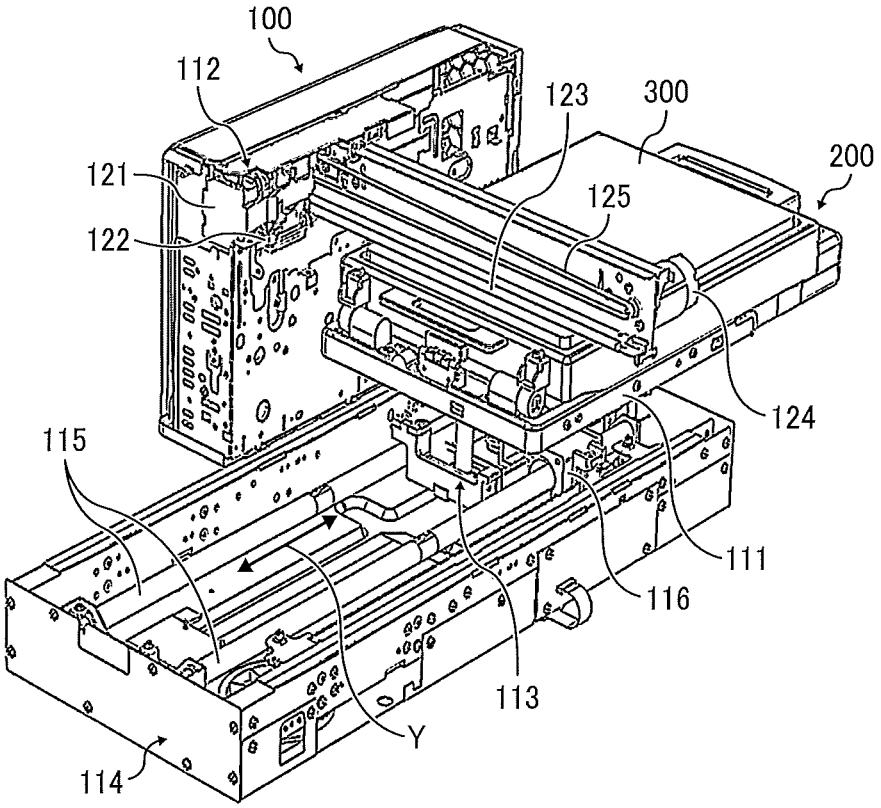
FIG. 12 is a perspective view of the printing apparatus seen from a direction different from the direction of FIG. 9.

Next, an example of the printing apparatus is described with reference to FIGS. 10 to 12. FIG. 10 is an outer perspective view of an example of the printing apparatus. FIG. 11 is a perspective view of the entire configuration of the printing apparatus of FIG. 10. FIG. 12 is a perspective view of the printing apparatus of FIG. 10 seen from a direction different from FIG. 11.

The printing apparatus 1 includes a stage 111 and a printing device 112 in a body 100. The stage 111 is a receiving member to move back and forth and hold the cassette 200, which is to hold the cloth 400, so that the cassette 200 is detachably mounted in the body 100. The printing device 112 performs printing on the cloth 400 held by the cassette 200, which is held by the stage 111.

Here, examples of the cloth 400 include not only a cloth made of a single piece of cloth, such as a handkerchief or a towel, but also a cloth processed as a clothing, such as a T-shirt or a trainer, a cloth constituting part of a product, such as a tote bag, and so forth.

The stage 111 is disposed on a conveyance structure 113 that is held so as to be movable in a direction (feed direction) indicated by arrow Y (hereinafter, Y direction) with respect to the body 100. Here, conveyance guides 115 are arranged along the Y direction in a bottom casing 114 of the body 100. Slider portions 116 of the conveyance structure 113 are movably held by the conveyance guides 115. The stage 111 is disposed so as to be movable upward and downward in a direction indicated by arrow Z (hereinafter Z direction) with respect to the slider portions 116, thus allowing adjustment of a gap between the stage 111 and a head 122 of the printing device 112.

The printing device 112 includes a carriage 121 and the head 122. The carriage 121 is movable in a direction (main scanning direction) indicated by arrow X (hereinafter, X direction) with respect to the stage 111. The head 122 is mounted on the carriage 121. The carriage 121 is movably held with a guide 123 disposed along the X direction. A driving motor 124 moves the carriage 121 back and forth the X direction via a scanning assembly, such as a timing belt 125. In this example, the head 122 is a liquid discharge head to discharge ink onto a surface of a cloth to form an image. However, examples of the head are not limited to the liquid discharge head but may be any other suitable type of head.

In the printing apparatus 1, with the cloth 400 set on the cassette 200, the cassette 200 is held and mounted on the stage 111 in the body 100. By repeating the reciprocal movement of the stage 111 along the Y direction and the reciprocal movement of the head 122 in the X direction, a desired image is printed on the cloth 400.

Figure 13:
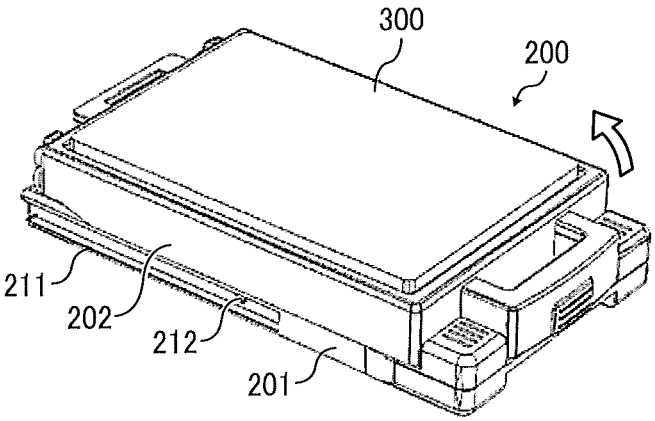
FIG. 13 is a perspective view of an example of a cassette which is a tray according to an embodiment of the present disclosure.
Figure 14:
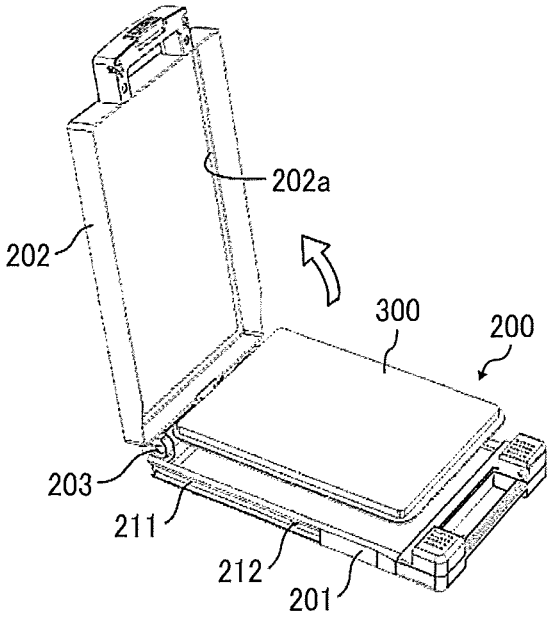
FIG. 14 is a perspective view of the cassette of FIG. 13 in a state in which a peripheral cover is opened.
Figure 15:
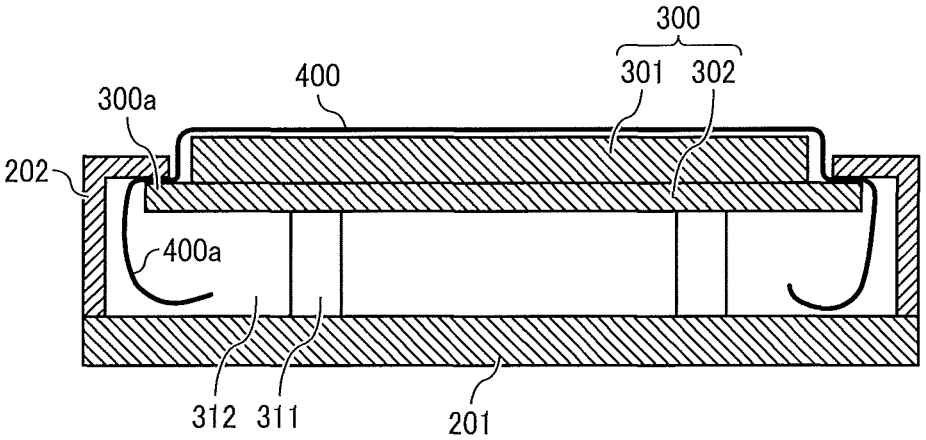
FIG. 15 is a cross-sectional view of the cassette of FIG. 13 cut along the short direction of the cassette.

Next, an example of the cassette is described with reference to FIGS. 13 to 15. FIG. 13 is a perspective view of an example of the cassette. FIG. 14 is a perspective view of a state in which a peripheral cover of the cassette of FIG. 13 is opened. FIG. 15 is a cross-sectional view of the cassette of FIG. 13 cut along the short direction of the cassette.

The cassette 200 has a cassette base 201 being a base member, and a platen 300. The platen 300 is a cloth holder to hold a print target portion of the cloth 400 in a flat state.

The platen 300 includes a platen structure 302 and a heat insulator 301. The heat insulator 301 constitutes a surface to hold the cloth 400 in a flat state. The heat insulator 301 has heat resistance against heating by the heating apparatus 500.

A platen peripheral cover 202, which is an outer peripheral cover, is provided on the cassette base 201 so as to be openable and closable in a direction indicated by arrow by a hinge 203. The platen peripheral cover 202 has an opening 202*a* in a portion corresponding to the platen 300 and presses the cloth 400 between the platen peripheral cover 202 and a flange portion 300*a* that is an outer peripheral portion of the platen 300.

The platen 300 is supported by supports 311 with respect to the cassette base 201 and an accommodation space 312 is formed between the platen 300 and the cassette base 201, to accommodate a surplus portion 400*a* of the cloth 400. Examples of the surplus portion 400*a* are sleeves, collar mouth, skirt, etc. when printing is performed on the front side of, e.g., a T-shirt.

Here, the platen 300 is attachable to and detachable from the cassette base 201 and is exchangeable. Accordingly, a plurality of platens 300 can be prepared so that, during printing operation on a cloth on one platen 300, another cloth can be wound around another platen 300. By simply replacing the platen 300 after printing and fixing, printing of the next cloth can be promptly started.

When the cloth 400 is set in the cassette 200, as illustrated in FIG. 14, the platen peripheral cover 202 is opened and the cloth 400 is set (held) on the platen 300. At this time, as illustrated in FIG. 13, the platen peripheral cover 202 is closed in a state illustrated in FIG. 15 where the surplus portion (extra portion) 400*a* of the cloth 400 is accommodated in the accommodation space 312.

When an image is printed on the cloth 400, the cassette 200 is mounted (set) on the stage 111 of the body 100 of the printing apparatus 1.

As described above, the cloth 400 to be printed can be placed on the platen 300 in a state where the entire cassette 200 is taken out of the body 100, thus facilitating the work of setting the cloth 400 on the platen 300.

After completion of printing with the printing apparatus 1, the cassette 200 can be set and heated on the receiver 503, the table 513, or the table 553 of the heating apparatus 500 while holding the cloth 400, thus enhancing the workability of heating.

Figure 16:
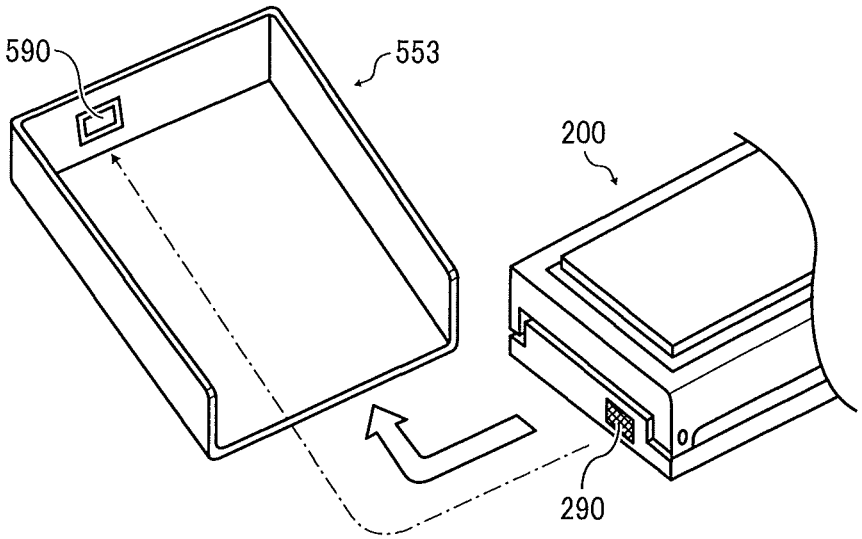
FIG. 16 is a perspective view of an example of an information storage of the cassette.

Next, an information storage of the cassette is described with reference to FIG. 16. FIG. 16 is a perspective view of an example of the information storage of the cassette.

An information storage 290 to hold information is provided at a part of the cassette 200. The information storage 290 is preferably provided at a position at which the information storage 290 is inserted into the body 100 of the printing apparatus 1 or the body 501 of the heating apparatus 500.

On the other hand, a writing-and-reading unit 590 to write and read information to and from the information storage 290 is disposed on the table 553 (or the table 513 in the second embodiment) of the heating apparatus 500. Likewise, another writing-and-reading unit 590 to write and read information to and from the information storage 290 is disposed on the stage 111 of the printing apparatus 1.

The information storage 290 and the writing-and-reading unit 590 may be either contact type or non-contact type. Here, the information storage 290 of the cassette 200 can hold information (fixing data) relating to, e.g., heating temperature and heating time (for each region in case of performing divided heating) and information on printing.

Accordingly, by attaching the cassette 200 to the heating apparatus 500, the heating temperature and heating time can be read on the heating apparatus 500 side to perform heating control according to the read heating temperature and heating time.

Figure 17:
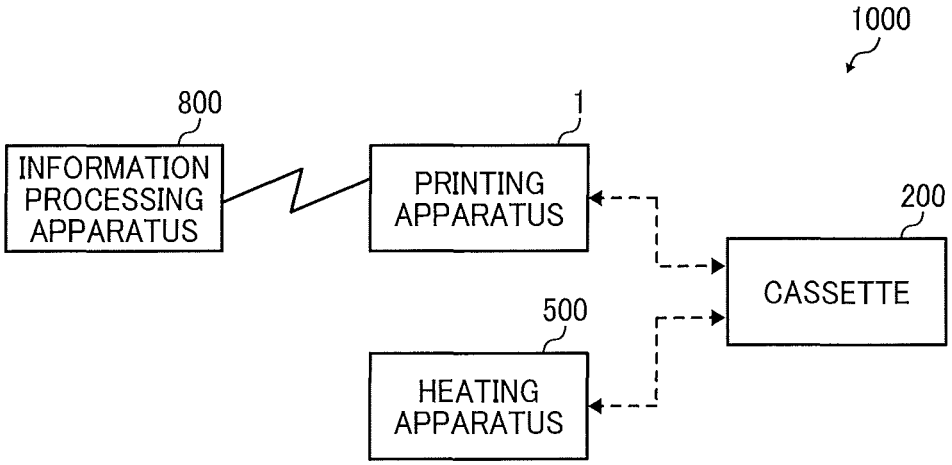
FIG. 17 is a block diagram of an image applying system including the heating apparatus according to an embodiment of the present disclosure.

Next, an image applying system is described with reference to FIG. 17. FIG. 17 is a block diagram of an image applying system 1000 including the heating apparatus 500 according to an embodiment of the present disclosure.

In the present embodiment, the image applying system 1000 includes the printing apparatus 1, the heating apparatus 500, and the cassette 200 to be shared by the printing apparatus 1 and the heating apparatus 500. The heating apparatus 500 according to the present embodiment has the same configuration as the configuration of the heating apparatus 500 according to the second embodiment. However, the configuration of the heating apparatus 500 is not limited to the configuration in the second embodiment but may be the configuration of, for example, the first embodiment or the third embodiments. The printing apparatus 1 is connected to, e.g., an information processing apparatus 800 via a network infrastructure or a cable.

Figure 18:
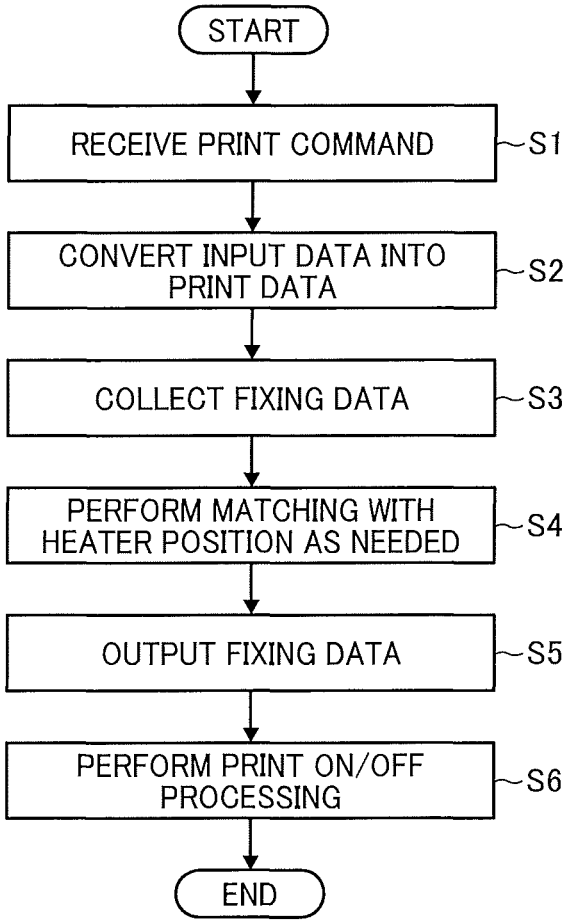
FIG. 18 is a flowchart of processing of the information processing apparatus in the image applying system of FIG. 17.
Figure 19:
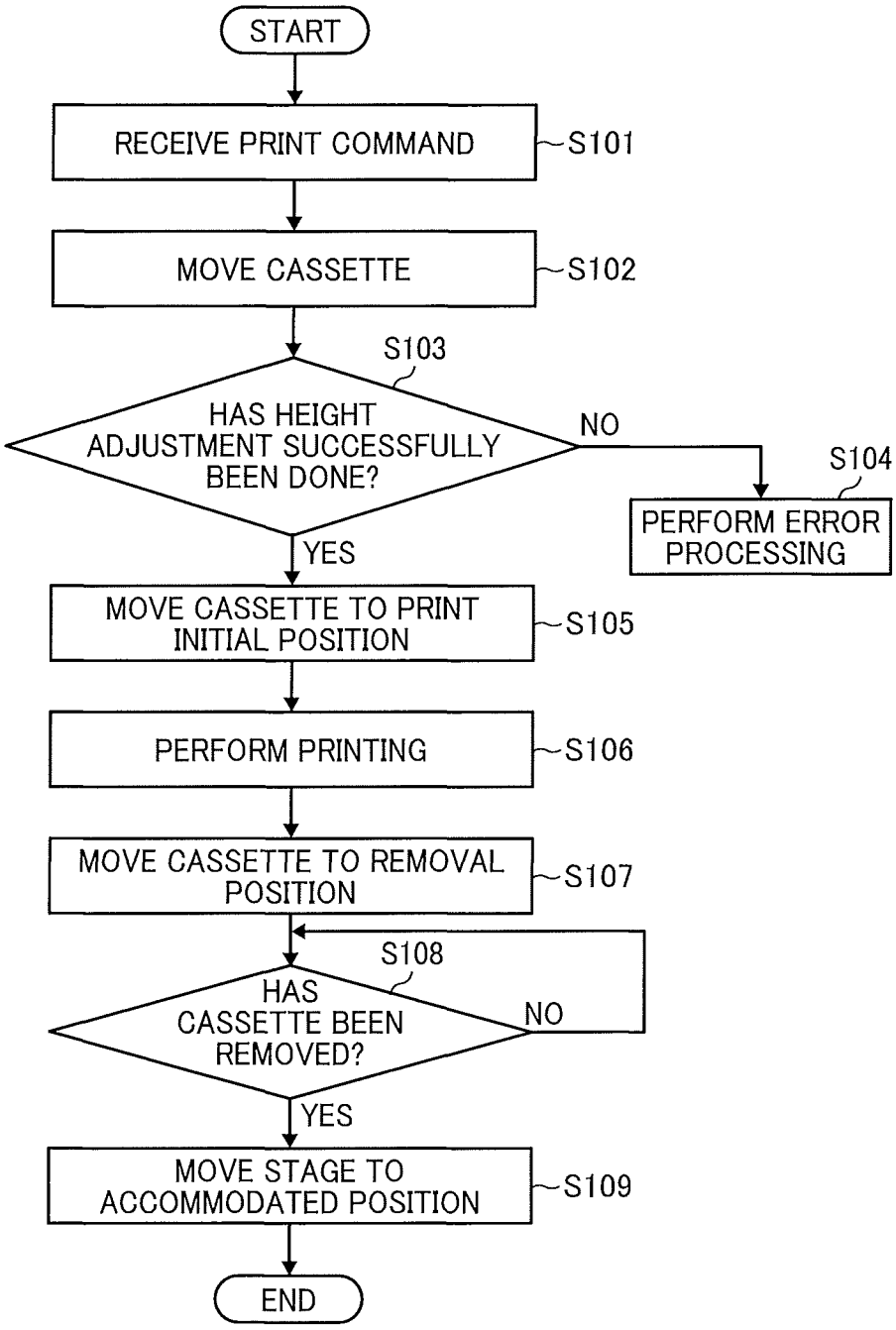
FIG. 19 is a flowchart of control in the printing apparatus of the image applying system of FIG. 17.
Figure 20:
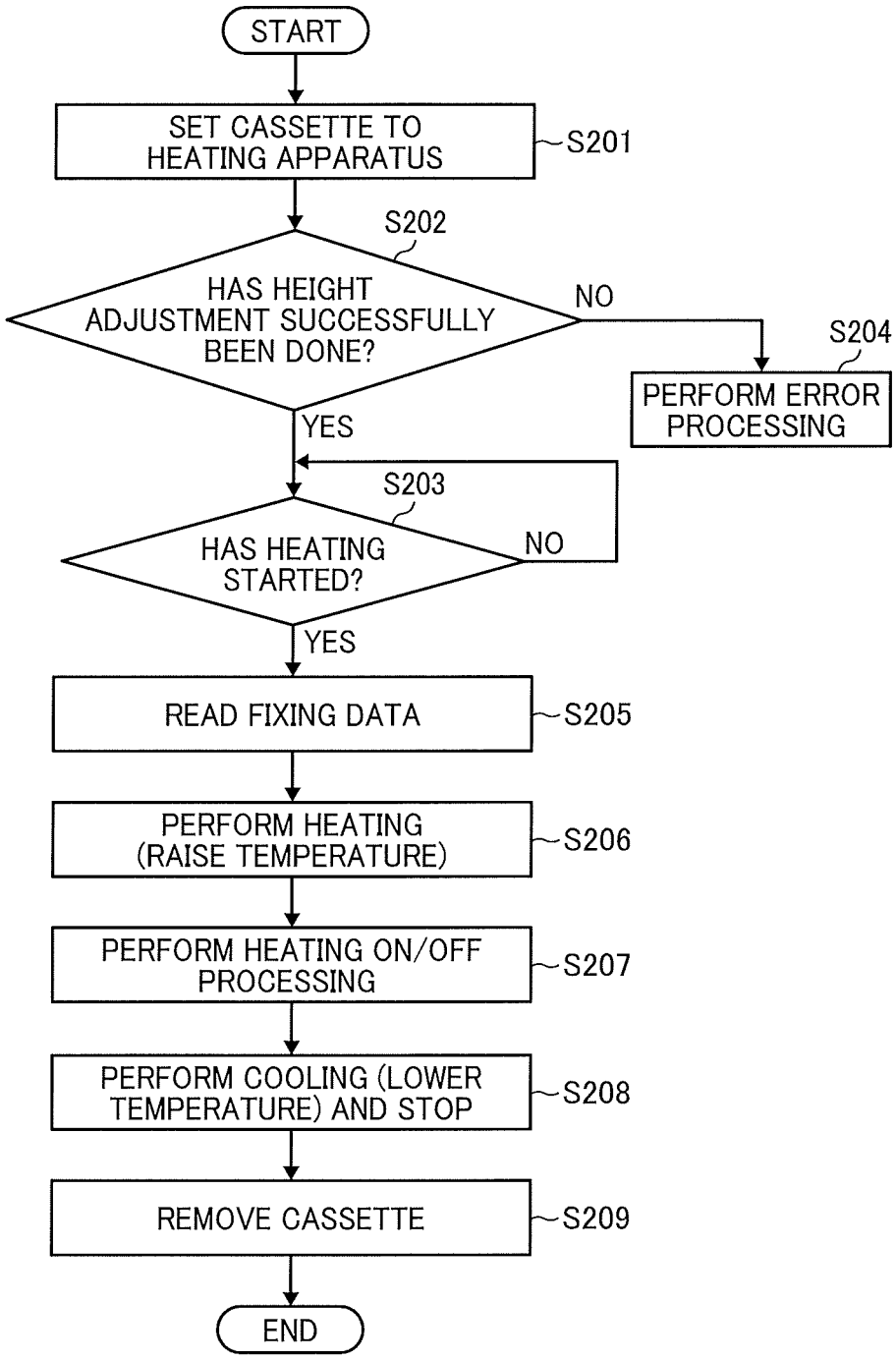
FIG. 20 is a flowchart of control in the heating apparatus of FIG. 17.

Next, image applying control in the image applying system 1000 is described with reference to FIGS. 18 to 20. FIG. 18 is a flowchart of a process on the information processing apparatus 800. FIG. 19 is a flowchart of control in the printing apparatus 1. FIG. 20 is a flowchart of control in the heating apparatus 500.

As illustrated in FIG. 18, at S1, the information processing apparatus 800 receives a print command and performs processing, such as color development of input image data into Bk, C, M, and Y, to convert the input image data into data for printing apparatus (print data) (S2).

At S3, the information processing apparatus 800 collects fixing data used for heating of the heating apparatus 500. As for the contents of the collected data, the information processing apparatus 800, for example, expands the print data to A4-size data, checks whether there is print data in each heater portion 504A in the above-described second embodiment, and generates fixing data, such as heating temperature, heating time, and region data, to partially control heating so that one heater portion 504A having print data is heated and another heater portion 504A having no print data is not heated. Then, the information processing apparatus 800 performs processing of matching with the positions of the heater portions 504A, as needed.

At S5, the information processing apparatus 800 outputs the collected fixing data to the printing apparatus 1. The cassette 200, on which a cloth 400 is set, is mounted on the printing apparatus 1. The printing apparatus 1 writes the fixing data received from the information processing apparatus 800 onto the information storage 290 of the cassette 200 through the writing-and-reading unit 590.

At S6, the information processing apparatus 800 performs print ON/OFF processing and transfers the print data to the printing apparatus 1.

As illustrated in FIG. 19, when the printing apparatus 1 receives the print command from information processing apparatus 800 (S101), at S102 the printing apparatus 1 moves the stage 111, on which the cassette 200 is mounted, from a cassette removal position (cassette attachment-and-detachment position) toward a print initial position and temporarily stops the stage 111 at a height adjustment position.

The printing apparatus 1 raises the stage 111 to adjust the height of the cassette 200, and detects the cassette 200 with a cassette height sensor to determine whether the height adjustment has successfully been done (S103).

When the cassette 200 is raised to a predetermined height and the height adjustment has been successfully done (YES at S103), the printing apparatus 1 further moves the cassette 200 toward the print initial position and stops the cassette 200 at the print initial position (S105). When the height adjustment of the cassette 200 has not been successfully done (NO at S103), the process shifts to error processing (S104).

While the stage 111 is moved from the print initial position toward the cassette removal position, the printing device 112 performs printing on the cloth 400 held by the cassette 200 according to the print data received from the information processing apparatus 800 (S106).

When printing is completed, the stage 111, on which the cassette 200 is mounted, moves to and stops at the cassette removal position (S107).

At S108, the printing apparatus 1 determines whether the cassette 200 has been removed from the stage 111, using, for example, a cassette mount sensor. When the cassette 200 has been removed from the stage 111 (YES at S108), at S109 the printing apparatus 1 temporarily moves the stage 111 to an accommodated position, at which the stage 111 is accommodated in the body 100, and terminates the process.

As illustrated in FIG. 20, when the cassette 200 holding the cloth 400 is set on the table 513 and the start of heating is instructed (S201), the heating apparatus 500 drives the motor 515 to raise the lift 514 to a predetermined height. The heating apparatus 500 detects with the distance sensor 516 whether the table 513 has been raised to the predetermined height, and determines whether the height adjustment has been successfully done (S202).

When the height adjustment of the table 513 has not been successfully done (NO at S202), the process shifts to error processing (S204). When the height adjustment of the table 513 has been successfully done (YES at S202) and the heating has been started (YES at S203), the heating apparatus 500 reads out the fixing data stored in the information storage 290 of the cassette 200 (S205).

At S206, the heating apparatus 500 heats (raises the temperature of) the heater portions 504A according to the read fixing data while controlling the heat generation temperature by turning on and off the heater portions 504A (S207). Such a configuration can heat only a region to be heated, thus reducing the power consumption.

The cassette 200 is removed from the heating apparatus 500 after cooling (S209).

When the heating apparatus 500 performs preliminary processing (pre-pressing), in the process of FIG. 20, the heating apparatus 500 performs loading operation between the reading of the fixing data and the heating (temperature increase) or between the heating (temperature increase) and the turning ON/OFF of the fixing. Similarly, the heating apparatus 500 performs separating operation between the turning ON/OFF of the fixing and the cooling (temperature lowering) or between the cooling (temperature lowering) and the stopping.

Note that the shape of the cloth holder is not limited to the box shape of the cassette in the above-described embodiments, but may be any other suitable shape as long as the cloth holder can be attached to and detached from the printing apparatus and the heating apparatus. For example, the cloth holder may be a single plate-shaped platen member that is insertable into the printing apparatus and the heating apparatus.

Further, as a way of enhancing the workability of printing operation, for example, a cloth holder with a cloth, such as T-shirt, being already set can be used to eliminate the process in which an operator sets the cloth on the cloth holder every time printing is performed. In such a case, the used cloth holder is collected and supplied in a state in which a cloth is set on the cloth holder again. As described above, the cloth set on the cloth holder can be commercialized and distributed for commercial transaction as a cloth holder with a cloth that holds a print surface of the cloth flat.

Further, to achieve the same effect, a platen member with a cloth (e.g., T-shirt) can be used in which the cloth has been already set on the platen member detachably attachable to the cloth holder. In the case of using, the platen member with the already-set cloth is directly mounted on the cloth holder. After completion of printing and fixing, the platen member is removed from the cloth holder. Then, the next platen member with an already-set cloth is mounted on the cloth holder, and printing and fixing are performed on the already-set cloth. In such a case, the used platen member is collected and supplied in a state in which a cloth is set on the platen member again. Similarly with the above-described example, the cloth set on the platen member can be commercialized and distributed for commercial transaction as a platen member with a cloth that holds a print surface of the cloth flat.

Such a configuration can obviate an operator's setting of a cloth (e.g., T-shirt) every time, facilitate continuous processing of a plurality of sheets, and automate continuous processing of a plurality of sheets.

In an apparatus, such as a textile printing apparatus, to apply an image on a cloth (including a processed article, such as a T-shirt), for example, when printing is performed using a liquid discharge head, the apparatus not only dries the cloth on which liquid is adhered to print an image, but also fixes the image on the cloth by heating the cloth for a certain period of time at relatively high temperature.

However, when such a configuration in which a heating area and a non-heating area are provided in one apparatus is used for an apparatus that applies an image to a cloth, the required temperature and heating time increase and the size of the apparatus is likely to increase due to the necessity of a stricter structure for cooling and heat insulation.

Accordingly, an apparatus of printing an image on a cloth (hereinafter, printing apparatus) and a heating apparatus used as a device of fixing the image (hereinafter, fixing device) are disposed separately from each other. An operator sets and print a cloth in the printing apparatus, removes the printed cloth, and sets the printed cloth again in the heating apparatus separately provided from the printing apparatus, thus causing less workability.

As described above, according to embodiments of the present disclosure, the workability in heating a cloth can be enhanced.

In the above-described embodiments, the example in which the cloth is a T-shirt or the like is described. However, the embodiments of the present disclosure is similarly applicable to a case in which the print target or the heating target is not only the cloth but also a medium (media). In such a case, the cloth in the above-described embodiments corresponds to the medium, and the cloth holder corresponds to a medium holder.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A cloth heating apparatus, comprising:

a body;

a receiver disposed in the body;

a cloth holder removably attached to the receiver, to hold a cloth; and a heater disposed in the body, to heat the cloth, wherein the cloth holder is removable from a printing apparatus to print an image on the cloth, with the cloth held on the cloth holder, and is attachable to the printing apparatus with the cloth held on the cloth holder, and the cloth holder is replaceable with another cloth holder holding another cloth on which another image is formed.

2. The cloth heating apparatus according to claim 1, further comprising a moving device to relatively move the cloth holder attached to the receiver and the heater.

3. The cloth heating apparatus according to claim 2, wherein the moving device is a lift to move the cloth holder attached to the receiver upward and downward relative to the heater.

4. The cloth heating apparatus according to claim 1, wherein the heater is one of a rubber heater and a mica heater.

5. The cloth heating apparatus according to claim 1, wherein the heater includes a plurality of divided heating regions adjustable in heat generation amount.

6. A cloth heating method using the cloth heating apparatus according to claim 1, the method comprising:

one of pressing the heater and the cloth held on the cloth holder with a pressure of 50 kPa or less and holding the heater and the cloth held on the cloth holder in non-contact with each other; and heating the cloth holder with the heater at a temperature of 170° C. or less for a time period of one minute or greater and two minutes or less.

7. A cloth heating method using the cloth heating apparatus according to claim 1, the method comprising:

heating the cloth before the image is printed on the cloth; and heating the cloth after the image is printed on the cloth with the printing apparatus.

8. The cloth heating method according to claim 7, further comprising one of:

heating the cloth with the heater and the cloth held on the cloth holder pressed, when the cloth is heated before the image is printed on the cloth;

heating the cloth with the heater and the cloth held on the cloth holder away from each other, when the cloth is heated after the image is printed on the cloth; and heating the cloth with the heater and the cloth held on the cloth holder pressed at a weaker force than when the cloth is heated before the image is printed on the cloth.

9. A method of applying an image to a cloth, the method comprising:

holding the cloth on a cloth holder;

attaching the cloth holder holding the cloth to a cloth heating apparatus;

preheating the cloth with the cloth holder holding the cloth being attached to the cloth heating apparatus;

removing the cloth holder from the cloth heating apparatus after the preheating;

attaching the cloth holder removed from the cloth heating apparatus to a printing apparatus;

printing an image on the cloth with the printing apparatus;

removing the cloth holder from the printing apparatus after the printing;

attaching the cloth holder removed from the printing apparatus to the cloth heating apparatus; and postheating the cloth having the image, with the cloth holder holding the cloth being attached to the cloth heating apparatus.

10. A medium heating apparatus, comprising:

a body;

a receiver disposed in the body;

a medium holder removably attached to the receiver, to hold a medium;

a heater disposed in the body, to heat the medium; and a moving device to relatively move the medium holder attached to the receiver and the heater when the heater heats the medium, wherein the medium holder is removable from a printing apparatus to print an image on the medium, with the medium held on the medium holder, and is attachable to the printing apparatus with the medium held on the medium holder, and the medium holder is replaceable with another medium holder holding another medium on which another image is formed.

* * * * *